US009648681B2

(12) United States Patent
Himeda et al.

(10) Patent No.: US 9,648,681 B2
(45) Date of Patent: May 9, 2017

(54) LIGHTING DEVICE AND LUMINAIRE

(71) Applicant: Panasonic Intellectual Property Management Co., Ltd., Osaka (JP)

(72) Inventors: Masato Himeda, Nara (JP); Hiroyuki Asano, Nara (JP); Masafumi Yamamoto, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/200,289

(22) Filed: Jul. 1, 2016

(65) Prior Publication Data

US 2017/0013685 A1 Jan. 12, 2017

(30) Foreign Application Priority Data

Jul. 9, 2015 (JP) ..... 2015-138060

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01); *H05B 37/0281* (2013.01)

(58) Field of Classification Search
CPC ..... H05B 33/0815; H05B 33/0845; H05B 37/0281
USPC ..... 315/200 R, 209 R, 217, 185 R, 297
See application file for complete search history.

(56) References Cited

U.S. PATENT DOCUMENTS

2008/0088252 A1* 4/2008 Chen ..... H05B 33/0818 315/224
2011/0074292 A1 3/2011 Maehara
2012/0262080 A1 10/2012 Watanabe et al.
2013/0141017 A1 6/2013 Esaki et al.

FOREIGN PATENT DOCUMENTS

JP 2007-122944 A 5/2007
JP 2011-070966 A 4/2011
JP 2012-204026 A 10/2012
JP 2013-118134 A 6/2013
JP 2013-243069 A 12/2013

* cited by examiner

*Primary Examiner* — Daniel D Chang
(74) *Attorney, Agent, or Firm* — Renner, Otto, Boisselle & Sklar, LLP

(57) ABSTRACT

A lighting device includes: a signal converting circuit which receives a dimming signal that is a rectangular voltage signal, and converts the dimming signal to a DC voltage signal corresponding to a duty ratio of the dimming signal; and a power supply circuit which receives an AC voltage and outputs DC current having a current value corresponding to the DC voltage signal. The signal converting circuit includes a resistor-capacitor (RC) circuit which integrates a signal corresponding to the dimming signal by way of charging and discharging to produce the DC voltage signal, and a time constant of the RC circuit during charging is greater than a time constant of the RC circuit during discharging.

7 Claims, 8 Drawing Sheets

LIGHTING DEVICE AND LUMINAIRE

CROSS REFERENCE TO RELATED APPLICATION

This application claims the benefit of priority of Japanese Patent Application Number 2015-138060 filed on Jul. 9, 2015, the entire content of which is hereby incorporated by reference.

BACKGROUND

1. Technical Field

The present disclosure relates to lighting devices and luminaires, and in particular to a lighting device and a luminaire having a dimming function.

2. Description of the Related Art

A lighting device having a dimming function is known as a lighting device which supplies current to a solid-state light-emitting element such as a light emitting diode (LED). Such a lighting device includes a light dimmer, etc. for controlling a dimming ratio, and is capable of obtaining an arbitrary dimming ratio based on a user's operation performed on the light dimmer, etc.

In order to facilitate adjustment of brightness of light omitted from the lighting device having the dimming function, it is preferable that brightness perceived by a user linearly varies with respect to an amount of dimming operation performed by a user. However, human visibility characteristics are not proportional to a dimming ratio. For that reason, if the dimming ratio is made proportional to the amount of dimming operation performed by a user, it is not possible to linearly vary the brightness perceived by the user with respect to the amount of the user's operation.

In view of the above, a luminaire which receives a pulse width modulation (PWM) signal having a duty ratio proportional to the amount of a user's operation, and performs dimming of which a dimming ratio is proportional to approximately the 2.3th power of the duty ratio of the PWM signal is known (for example, Japanese Unexamined Patent Application Publication No. 2007-122944).

SUMMARY

The luminaire disclosed by Japanese Unexamined Patent Application Publication No. 2007-122944, however, includes a microcomputer for converting a PWM signal to a DC voltage signal corresponding to a dimming ratio. For that reason, a region for mounting the microcomputer is required in a circuit board of the luminaire. Furthermore, by including the microcomputer, the costs of the luminaire increase compared to a luminaire without a microcomputer.

In view of the above, the present disclosure provides a lighting device which causes a solid-state light-emitting element to emit light and is capable of, with a simplified configuration, making the relationship between a duty ratio of a dimming signal and brightness which a person perceives from light emitted from the solid-state light-emitting element more linear, and a luminaire including the lighting device.

In order to solve the above-described problem, an aspect of a lighting device according to the present disclosure is a lighting device including: a signal converting circuit which receives a dimming signal that is a rectangular voltage signal, and converts the dimming signal to a DC voltage signal corresponding to a duty ratio of the dimming signal; and a power supply circuit which receives an AC voltage and outputs DC current having a current value corresponding to the DC voltage signal, wherein the signal converting circuit includes a resistor-capacitor (RC) circuit which integrates a signal corresponding to the dimming signal by way of charging and discharging to produce the DC voltage signal, and a time constant of the RC circuit during charging is greater than a time constant of the RC circuit during discharging.

According to the present disclosure, it is possible to provide a lighting device which causes a solid-state light-emitting element to emit light and is capable of, with a simplified configuration, making the relationship between a duty ratio of a dimming signal and brightness which a person perceives from light emitted from the solid-state light emitting element more linear, and a luminaire including the lighting device.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENT(S)

An embodiment according to the present disclosure will be described below with reference to the drawings. It should be noted that the embodiment described below indicates one specific example of the present disclosure. Thus, the numerical values, shapes, materials, structural components, the disposition and connection of the structural components, steps, the processing order of the steps, and others described in the following embodiment are mere examples, and do not intend to limit the present disclosure. Furthermore, among the structural components in the following embodiment, components not recited in any one of the independent claims which indicate the broadest concepts of the present disclosure are described as arbitrary structural components.

In addition, each of the diagrams is a schematic diagram and thus is not necessarily strictly illustrated. In each of the diagrams, substantially the same structural components are assigned with the same reference signs, and redundant descriptions will be omitted or simplified.

Embodiment

[1. Overall Configuration]

First, an overall configuration of a lighting device and a luminaire according to the embodiment will be described with reference to FIG. 1.

Figure 1:
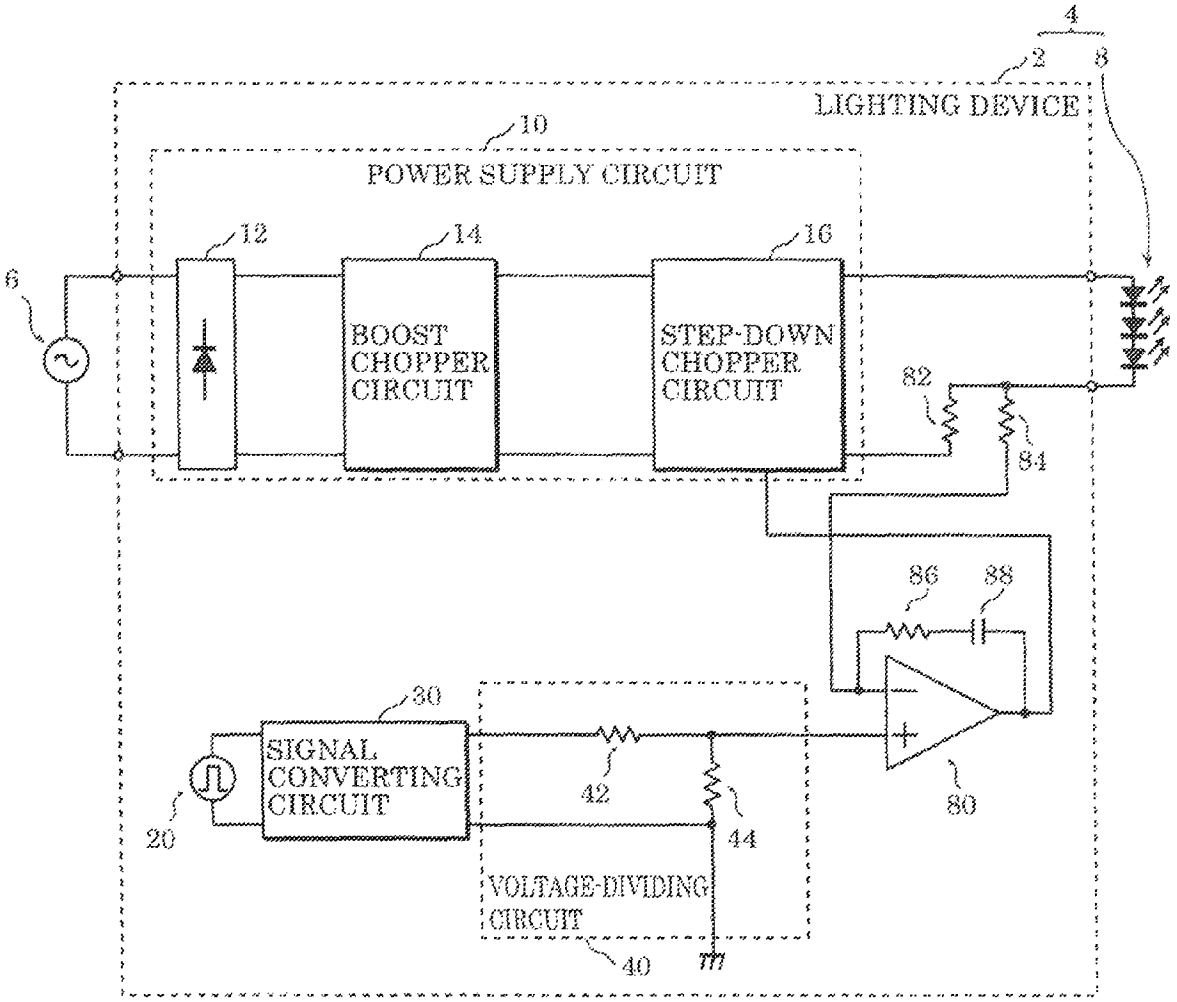
FIG. 1 is a circuit diagram illustrating a circuit configuration of a lighting device and a luminaire according to an embodiment.

FIG. 1 is a circuit diagram illustrating a circuit configuration of lighting device 2 and luminaire 4 according to the embodiment. It should be noted that AC power supply 6 which outputs an AC voltage is illustrated together in this diagram.

As illustrated in FIG. 1, luminaire 4 includes lighting device 2 and solid-state light-emitting element 8.

AC power supply 6 is a power supply which outputs an AC voltage to lighting device 2, and for example, a system power supply such as a commercial AC power supply.

Solid-state light-emitting element 8 is an element to which DC current is inputted from lighting device 2. Solid-state light-emitting element 8 is, for example, an LED, an organic electro luminescent (EL) element, etc.

Lighting device 2 is a device to which an AC voltage is inputted from AC power supply 6, and which supplies DC current to solid-state light-emitting element 8. As illustrated in FIG. 1, lighting device 2 includes power supply circuit 10, dimming signal source 20, signal converting circuit 30, voltage-dividing circuit 40, operational amplifier 80, and resistors 82 and 84.

Dimming signal source 20 is a signal source which outputs a dimming signal that is a rectangular voltage signal. According to the embodiment, dimming signal source 20 outputs a pulse width modulation (PWM) signal. A frequency of the dimming signal is not specifically limited. According to the embodiment, the frequency of the dimming signal is 1 kHz. As dimming signal source 20, a sight dimmer which determines a dimming ratio of solid-state light-emitting element 8 is employed, for example. Dimming signal source 20 includes a handle or the like (not shown) for adjusting a dimming degree. The handle for adjusting a dimming degree is, for example, a rotary handle or a sliding handle. A PWM signal having a duty ratio proportional to an operation amount such as a rotation amount of the handle or a sliding amount is outputted from dimming signal source 20. With lighting device 2 according to the embodiment, the dimming ratio decreases as the duty ratio of the PWM signal is greater. In other words, luminous flux emitted from luminaire 4 decreases as the duty ratio is greater.

Signal converting circuit 30 is a circuit which receives a dimming signal that is a rectangular voltage signal and converts the dimming signal to a DC voltage signal corresponding to a duty ratio of the dimming signal. According to the embodiment, signal converting circuit 30 receives a dimming signal from dimming signal source 20, and converts the dimming signal to a DC voltage signal having a voltage value proportional to approximately the 2.3th power of a duty ratio of the dimming signal. In addition, signal converting circuit 30 outputs the DC voltage signal to operational amplifier 80 via voltage-dividing circuit 40. A detailed configuration of signal converting circuit 30 will be described later.

Voltage-dividing circuit 40 is a circuit which divides the voltage of a DC voltage signal inputted to voltage-dividing circuit 40 from signal converting circuit 30. According to the embodiment, voltage-dividing circuit 40 includes resistors 42 and 44. Voltage-dividing circuit 40 divides the voltage of the DC voltage signal at a voltage dividing ratio determined by resistance values of resistors 42 and 44, and then outputs the DC voltage signal to a non-inverting, input terminal of operational amplifier 80. The DC voltage signal is converted by voltage-dividing circuit 40 to a signal having a voltage value in a predetermined range. It should he noted that, when the DC voltage signal outputted from signal converting circuit 30 has a voltage value in the predetermined range, lighting device 2 need not include voltage-dividing circuit 40.

Operational amplifier 80 is a circuit which amplifies a difference between a voltage corresponding to the duty ratio of a dimming signal and a voltage corresponding to current passing through solid-state light-emitting element 8. According to the embodiment, operational amplifier 80 amplifies a difference between a voltage of a signal outputted from voltage-dividing circuit 40 and a voltage applied to resistor 82 connected in series to solid-state light-emitting element 8. Operational amplifier 80 outputs a voltage resulting from amplifying the difference between the voltage inputted to the non-inverting input terminal and the voltage inputted to an inverting input terminal.

Resistor 82 is a sensing resistor for detecting current passing through solid-state light-emitting element 8, that is, output current of power supply circuit 10. Resistor 82 is connected in series to solid-state light-emitting element 8.

Resistor 84 is a resistor which determines an amplification factor of operational amplifier 80. Resistor 84 has one terminal connected to a connection between solid-state light-emitting element 8 and resistor 82, and the other terminal connected to the inverting input terminal of operational, amplifier 80.

Resistor 86 and capacitor 88 are elements which determine the amplification factor and frequency characteristics of operational amplifier 80. A circuit in which resistor 86 and capacitor 88 are connected in series is connected to a negative feedback circuit of operational amplifier 80.

Power supply circuit 10 is a circuit which receives an AC voltage and outputs DC current having a current value corresponding to the DC voltage signal. As illustrated in FIG. 1, power supply circuit 10 includes rectifier circuit 12, boost chopper circuit 14, and step-down chopper circuit 16.

Rectifier circuit 12 is s circuit which rectifies an AC voltage inputted from AC power supply 6. As rectifier circuit 12, for example, a diode bridge can be employed.

Boost chopper circuit 14 is a DC power supply circuit which boosts and outputs a DC voltage inputted from rectifier circuit 12. Boost chopper circuit 14 may be any known DC current circuit which boosts and outputs a DC voltage inputted, and the configuration of boost chopper circuit 14 is not specifically limited.

Step-down chopper circuit 16 is a DC power supply circuit which steps down and outputs a DC voltage inputted from boost chopper circuit 14. Furthermore, step-down chopper circuit 16 adjusts output current based on a signal inputted from operational amplifier 80. More specifically, step-down chopper circuit 16 includes a switching element, and adjusts ON time of the switching element based on a signal voltage inputted from operational amplifier 80, thereby adjusting output current. In this manner, step-down chopper circuit 16 is capable of performing feedback control on the output current to equalize the voltage inputted to the non-inverting input terminal of operational amplifier 80 and the voltage inputted to the inverting input terminal of operational amplifier 80. Here, as described above, the voltage inputted to the non-inverting input terminal of operational amplifier 80 is a voltage corresponding to a dimming signal, and the voltage inputted to the inverting input terminal is a voltage corresponding to output current of step-down chopper circuit 16. Accordingly, step-down chopper circuit 16 is capable of adjusting output current to have a current value corresponding to the dimming signal.

[2. Configuration of the Signal Converting Circuit]

Next, a configuration of signal converting circuit 30 will be described in detail, with reference to FIG. 2.

Figure 2:
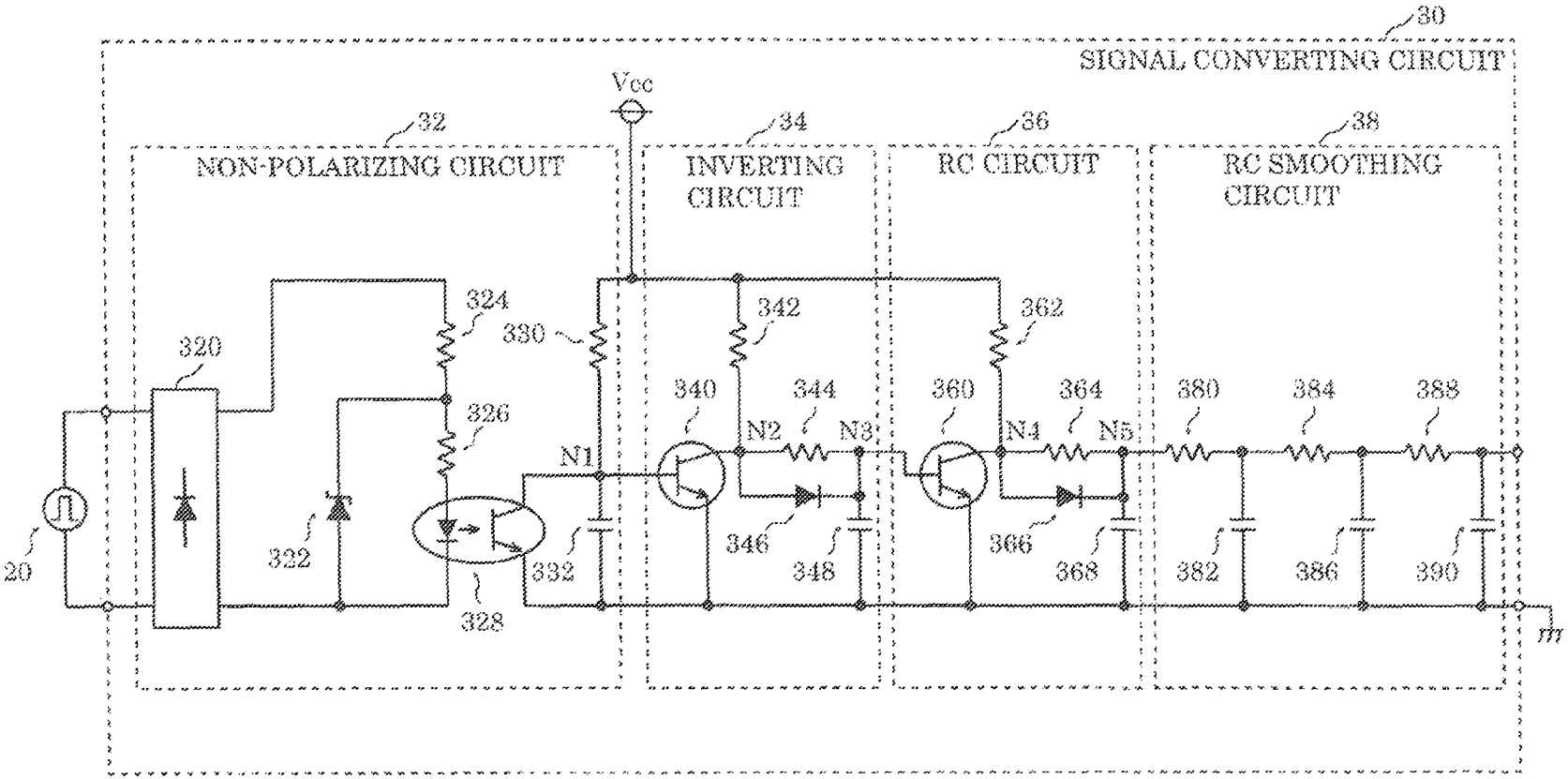
FIG. 2 is a circuit diagram illustrating a circuit configuration of a signal converting circuit according to the embodiment.

FIG. 2 is a circuit diagram illustrating a circuit configuration of signal converting circuit 30 according to the embodiment. It should be noted that dimming signal source 20 is illustrated together in this diagram.

As illustrated in FIG. 2, signal converting circuit 30 includes non-polarizing circuit 32, inverting circuit 34, RC circuit 36, and RC smoothing circuit 38.

[2-1. Non-Polarizing Circuit]

First, non-polarizing circuit 32 will be described. As illustrated in FIG. 2, non-polarizing circuit 32 includes rectifier circuit 320, Zener diode 322, resistors 324, 326, and 330, photocoupler 328, and capacitor 332. Accordingly, non-polarizing circuit 32 inputs a dimming signal outputted from dimming signal source 20, to an AC input terminal of rectifier circuit 320, and thus non-polarizing circuit 32 is a circuit into which a PWM signal can be inputted without consideration for the polarity of the PWM signal. In addition, non-polarizing circuit 32 also has a function of electrically isolating dimming signal source 20 from inverting circuit 34, using photocoupler 328.

Rectifier circuit 320 is a full-wave rectifier circuit which rectifies a dimming signal inputted from dimming signal source 20. As rectifier circuit 320, for example, a diode bridge can be employed.

Resistors 324 and 326 are elements for dividing a voltage outputted from rectifier circuit 320. Resistor 324 has one terminal connected to a high potential output terminal of rectifier circuit 320, and the other terminal connected to one terminal of resistor 326. The other terminal of resistor 326 is connected to an anode terminal of an input-side LED of photocoupler 328. A resistance value of each of resistors 324 and 326 is set, based on a voltage value of the dimming signal, characteristics of photocoupler 328, etc., to such a value that a predetermined voltage is applied to photocoupler 328. According to the embodiment, a resistance value of resistor 324 and a resistance value of resistor 328 are 2.7 kΩ and 3.9 kΩ, respectively.

Zener diode 322 is an element for stabilizing a voltage to he applied to photocoupler 328. Zener diode 322 has a cathode terminal connected to a connection between resistor 324 and resistor 326 and an anode terminal connected to a low potential output terminal of rectifier circuit 320. A breakdown voltage of Zener diode 322 is determined based on the characteristic of photocoupler 328. According to the embodiment, the breakdown voltage of Zener diode 322 is 4.7 V, for example.

Photocoupler 328 is an element for electrically isolating dimming signal source 20 from inverting circuit 34. The input-side LED of photocoupler 328 has an anode terminal connected to resistor 326, and a cathode terminal connected to the low potential output terminal of rectifier circuit 320. An output-side phototransistor of photocoupler 328 has a collector terminal connected to node N1 (the connection between resistor 330 and one terminal of capacitor 332), and an emitter terminal which is grounded. Photocoupler 328 is connected in this manner, and thus resistance between both terminals of the output-side phototransistor is reduced when a voltage applied to the input-side LED increases to be greater than or equal to a forward voltage of the input-side LED. When a voltage applied to the input-side LED of photocoupler 328 is lower than a forward voltage, resistance between both terminals of the output-side phototransistor is increased.

Resistor 330 is an element for restricting current passing through photocoupler 328 (and between a base and an emitter of transistor 340 of inverting circuit 34). Resistor 330 has one terminal connected to a DC power supply and applied with voltage Vcc, and the other terminal connected to node N1. A resistance value of resistor 330 is not specifically limited. According to the embodiment, a resistance value of resistor 330 is 15 kΩ, for example.

Capacitor 332 is a capacitor having low capacitance, for removing noise of a signal outputted from photocoupler 328. More specifically, capacitor 332 is a capacitor with capacitance which is small enough to the degree that a signal outputted from photocoupler 328 is not smoothed. Capacitor 332 has one terminal connected to node N1 and the other terminal which is grounded. Furthermore, the one terminal of capacitor 332 is connected to a base terminal of transistor 340 included by inverting circuit 34. According to the embodiment, the capacitance of capacitor 332 is 100 pF, for example.

As described above, since non-polarizing circuit 32 is included, it is possible, when a dimming signal is inputted to signal converting circuit 30, to connect dimming signal source 20 to signal converting circuit 30 without consideration for the polarity of the dimming signal. In addition, photocoupler 328 electrically isolates dimming signal source 20 from inverting circuit 34.

[2-2. Inverting Circuit]

Next, inverting circuit 34 will be described. Inverting circuit 34 is a circuit which logically inverts a signal outputted from non-polarizing circuit 32 to node N1 (in other words, inverts a high level and a low level of a signal), and outputs the signal to node N3. As illustrated in FIG. 2, inverting circuit 34 includes transistor 340, resistors 342 and 344, diode 346, and capacitor 348.

Resistor 342 is an element for restricting current passing through transistor 340. Resistor 342 has one terminal connected to a DC power supply and applied with voltage Vcc, and the other terminal connected to node N2. A resistance value of resistor 342 will be described later.

Resistor 344 is an element for restricting current passing through transistor 340. Resistor 344 has one terminal connected to node N2 and the other terminal connected to node N3. A resistance value of resistor 342 will be described later.

Diode 346 is a rectifying element for bypassing a path of current during charging of capacitor 348. Diode 346 has an anode terminal connected to node N2 and a cathode terminal connected to node N3. This means that diode 346 is connected in parallel to resistor 344.

Capacitor 348 is a capacitor having low capacitance, for removing noise of a signal outputted from inverting circuit 34. More specifically, capacitor 348 is a capacitor with capacitance which is small enough to the degree that a signal outputted from inverting circuit 34 is not smoothed. Capacitor 348 has one terminal connected to node N3 and the other terminal which is grounded. According to the embodiment, the capacitance of capacitor 348 is 100 pF, for example.

Transistor 340 is an element used for logically inverting a signal inputted to node N1. Transistor 340 has a base terminal connected to node N1, a collector terminal connected to node N2, and an emitter terminal which is grounded.

Inverting circuit 34 has a circuit configuration described above. Moreover, a resistance value of resistor 342 is set to be equal to a resistance value of resistor 344. With this, a time constant of an RC circuit which serves as a current path during charging of capacitor 348 is equalized to a time constant of an RC circuit which serves as a current path during discharging of capacitor 348. The following describes current paths in inverting circuit 34 during charging of capacitor 348 and during discharging of capacitor 348, with reference to FIG. 3.

Figure 3:
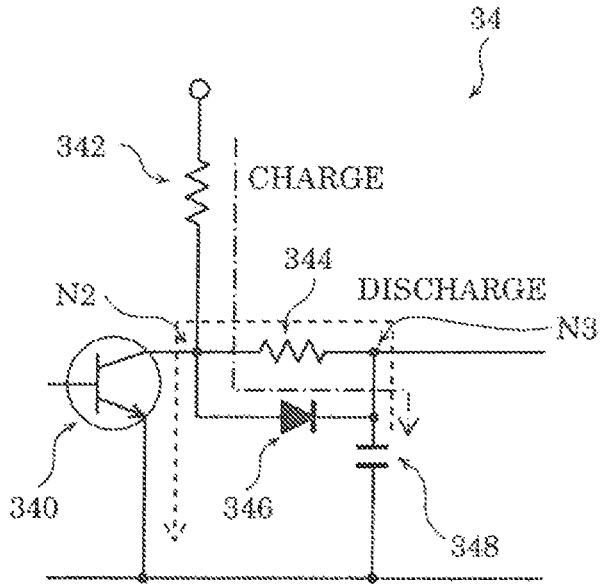
FIG. 3 is a circuit diagram illustrating a current path in an inverting circuit during charging and during discharging.

FIG. 3 is a circuit diagram illustrating a current path during charging and a current path during discharging in inverting circuit 34 according to the embodiment. It should be noted that a current path during charging and a current path during discharging in RC circuit 36 which will be described later are similar to those in inverting circuit 34.

During charging of capacitor 348, transistor 340 has a high resistance between the collector and the emitter (i.e., transistor 340 is considered to be electrically insulated between the collector and the emitter). In this case, since node N2 is higher in a potential than node N3, diode 346 is put in a conductive state and current does not pass through resistor 344. Accordingly, as illustrated by a dashed-dotted directional line in FIG. 3, the RC circuit which serves as a current path during charging of capacitor 348 is formed of resistor 342, diode 346, and capacitor 348. Therefore, a time constant of the RC circuit in this case is represented by a product of a resistance value of resistor 342 and capacitance of capacitor 348.

In contrast, during discharging of capacitor 348, transistor 340 has a low resistance between the collector and the emitter (i.e., transistor 340 is considered to he short-circuited between the collector and the emitter). In this case, since node N2 is lower in a potential than node N3, diode 346 is put in a non-conductive state and current passes through resistor 344. Accordingly, as illustrated by a dashed directional line in FIG. 3, the RC circuit which serves as a current path when capacitor 348 is being discharged is formed of resistor 344 and capacitor 348. Therefore, a time constant of the RC circuit in this case is represented by a product of a resistance value of resistor 344 and capacitance of capacitor 348.

It should be noted that the resistance value of resistor 342 need not he completely the same as the resistance value of resistor 344. Although an output signal from inverting circuit 34 has distortion due to an error between the resistance values, the error is tolerated if the degree of distortion is negligible.

[2-3. RC Circuit]

Next, RC circuit 36 will be described. RC circuit 36 is a circuit which integrates a signal corresponding to a dimming signal outputted from inverting circuit 34 to node N3 by way of charging and discharging to produce the DC voltage signal. As illustrated in FIG. 2, RC circuit 36 includes transistor 360, first resistor 362, second resistor 364, diode 366, and capacitor 368. The signal corresponding to the dimming signal is coupled to a base of the transistor, and the DC voltage signal is derived from a voltage across the capacitor.

First resistor 362 is an element for restricting current passing through transistor 360. First resistor 362 has one terminal connected to a DC power supply and applied with voltage Vcc, and the other terminal connected to node N4. A resistance value of first resistor 362 will be described later.

Second resistor 364 is an element for restricting current flowing through transistor 360. Second resistor 364 is connected in series to first resistor 362. According to the embodiment, second resistor 364 has one terminal connected to node N4 and the other terminal connected to node N5. A resistance value of second resistor 364 will be described later.

Diode 366 is a rectifying element for bypassing a path of current during charging of capacitor 368. Diode 366 is connected in parallel to second resistor 364. According to the embodiment, diode 366 has an anode terminal connected to node N4, and a cathode terminal connected to node N5.

Capacitor 368 is a capacitor having relatively large capacity, for integrating a signal inputted to RC circuit 36. Capacitor 368 is connected in series to second resistor 364. According to the embodiment, capacitor 368 has one terminal connected to node N5 and the other terminal which is grounded. Capacitance of capacitor 368 will be described later.

Transistor 360 is an element used for logically inverting a signal inputted to node N3. Transistor 360 is connected in parallel to a series circuit including second resistor 364 and capacitor 368. According to the embodiment, transistor 360 has a base terminal connected to node N3, a collector terminal connected to node N4, and an emitter terminal which is grounded. In this manner, the signal corresponding to the dimming signal is coupled to a base of transistor 360.

RC circuit 36 has a circuit configuration similar to a circuit configuration of inverting circuit 34, as described above. However, RC circuit 36 differs from inverting circuit 34 in that a time constant of RC circuit 36 during charging is greater than a time constant of RC circuit 36 during discharging. In other words, a resistance value of first resistor 362 is different from a resistance value of second resistor 364. According to the embodiment, a resistance value of first resistor 362 and a resistance value of second resistor 364 are 330 kΩ and 100 kΩ, respectively. These resistance values are determined based on, for example, a relationship to be achieved between a duty ratio of a dimming signal and a dimming ratio. In lighting device 2, for making the relationship between a duty ratio of a dimming signal and brightness which a person perceives from light emitted from solid-state light-emitting element 8 more linear, the resistance value of first resistor 362 may be, for example, between twice or greater and four times or less of the resistance value of second resistor 364.

Alternatively, a resistance value of first resistor 362 and a resistance value of second resistor 364 may be determined to set a time constant of RC circuit 36 during each of charging and discharging to be 10 times or greater of a period of a dimming signal. It should be noted that, even when a time constant of RC circuit 36 is less than ten times of a period of a dimming signal, it is possible to make the relationship between a duty ratio of the dimming signal and brightness which a person perceives from light emitted from solid-state light-emitting element 8 more linear, by increasing a time constant of RC smoothing circuit 38. However, increasing the time constant of RC smoothing circuit 38 increases the amount of time taken for the dimming ratio to converge when a dimming signal is changed. Accordingly, for causing a dimming ratio to converge rapidly when a dimming signal is changed, a time constant of RC circuit 36 during each of charging and discharging may be 10 times or greater of a period of a dimming signal. It should be noted that, since a time constant during discharging is less than a time constant during charging according to the embodiment, when the time constant during discharging is 10 times or greater of a period of a dimming signal the time constant during charging is naturally 10 times or greater of a period of a dimming signal.

The current paths during charging of capacitor 368 and during discharging of capacitor 368 are same as those in inverting circuit 34. Accordingly, a time constant of RC circuit 38 during charging is represented by a product of a resistance value of first resistor 362 and capacitance of capacitor 368.

A time constant of RC circuit 36 during each of charging and discharging is greater than a time constant of inverting circuit 34 during each of charging and discharging. According to the embodiment, the capacitance of capacitor 368 is 0.1 μF, as described above. In this manner, the resistance value of first resistor 362 and the resistance value of second resistor 364 of RC circuit 36 are greater than the resistance value of resistor 342 and the resistance value of resistor 344 of inverting circuit 34, respectively. In addition, the capacitance of capacitor 368 of RC circuit 36 is greater than the capacitance of capacitor 348 of inverting circuit 34. This allows RC circuit 36 to have a time constant greater than a time constant of inverting circuit 34.

[2-4. RC Smoothing Circuit]

Next, RC smoothing circuit 38 will be described. RC smoothing circuit 38 is a circuit which smoothes a signal outputted from RC circuit 36 to node N5. As illustrated in FIG. 2, RC smoothing circuit 38 includes resistors 380, 384, and 388, and capacitors 382, 386, and 390. RC smoothing circuit 38 includes RC integral circuits in three stages composed of an RC integral circuit including resistor 380 and capacitor 382, an RC integral circuit including resistor 384 and capacitor 386, and an RC integral circuit including resistor 388 and capacitor 390. According to the embodiment, a resistance value of each of resistors 380, 384, and 388 is 40 kΩ, and capacitance of each of capacitors 382, 386, and 390 is 0.1 μF.

In this manner, an RC integral circuit having a relatively small time constant is disposed in each of the three stages according to the embodiment. However, RC smoothing circuit 38 may be composed of an RC integral circuit in one stage, with a relatively great time constant. However, by including RC integral circuits each having a relatively small time constant in a plurality of stages as in the present embodiment, it is possible to accelerate convergence of a voltage value of an output signal, compared to the case where an RC integral circuit with a relatively great time constant is provided in one stage.

[3. Operation of the Signal Converting Circuit]

Next, an operation of signal converting circuit 30 will be described in detail with reference to FIG. 2 and FIG. 4.

Figure 4:
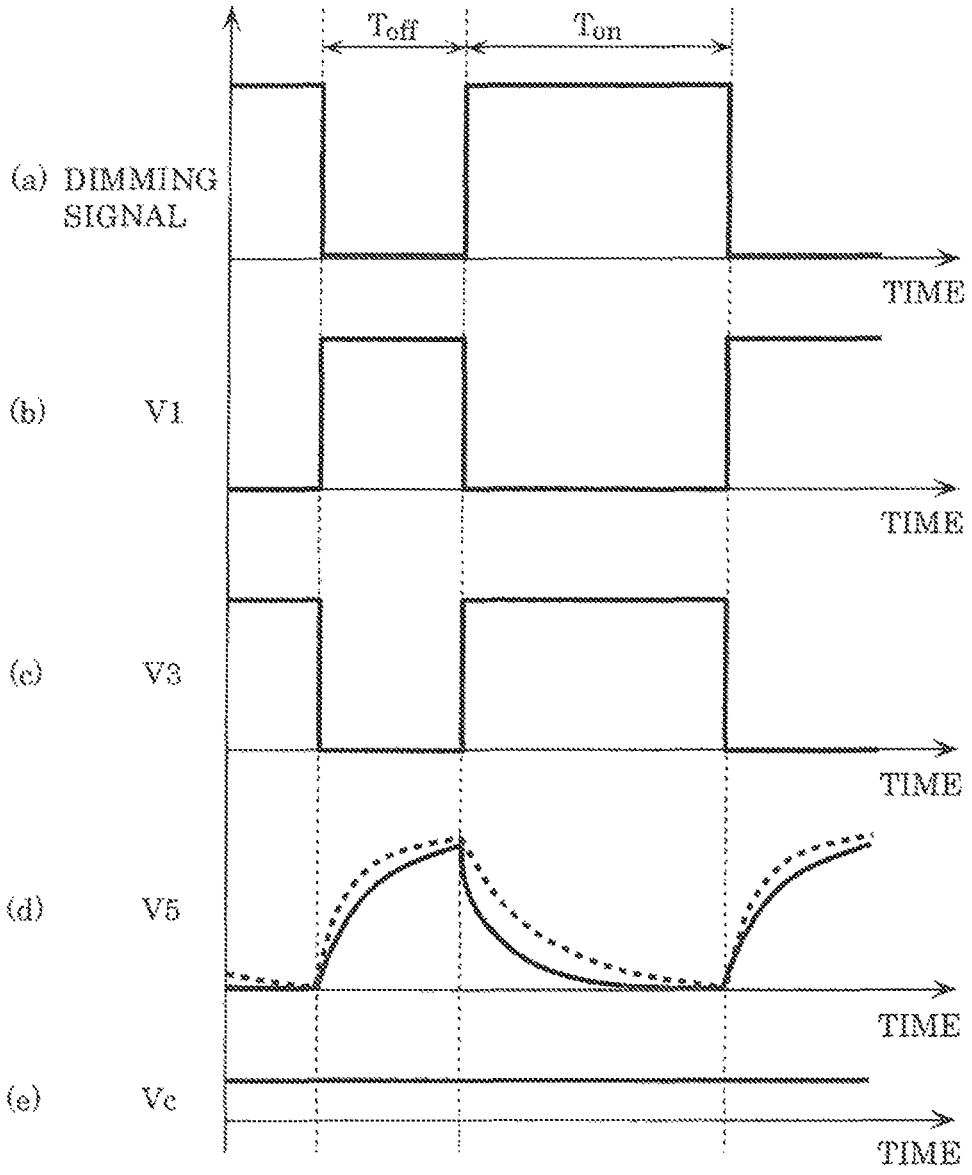
FIG. 4 is a diagram illustrating a graph indicating a waveform of a voltage value of a dimming signal and a waveform of each of voltage values of a signal at each node and an output terminal of the signal converting circuit in the lighting device according to the embodiment.

FIG. 4 is a diagram illustrating a graph indicating a waveform of a voltage value of a dimming signal and a waveform of each of voltage values of a signal at each node and an output terminal of signal converting circuit 30 in lighting device 2 according to the embodiment. A waveform of a voltage value of a dimming signal is illustrated in graph (a) of FIG. 4. In graphs (b), (c), and (d) of FIG. 4, a waveform of each of voltage values V1, V3, and V5 of a signal at each of nodes N1, N3, and N5 of signal converting circuit 30 is illustrated. Furthermore, a waveform of voltage value Vc of an output signal of signal converting circuit 30 is illustrated in graph (e) of FIG. 4.

As illustrated in graph (a) of FIG. 4, the dimming signal is a rectangular voltage signal which repeatedly switches between ON time Ton during which an output voltage is at a high level and OFF time Toff during which an output voltage is at a low level. Here, duty ratio Rd of the dimming signal is represented by a ratio of the ON time to a period of the dimming signal. Accordingly, duty ratio Rd of the dimming signal is represented by an expression indicated below.

$$Rd = Ton/(Ton + Toff)$$

When a dimming signal as indicated in graph (a) of FIG. 4 is provided from dimming signal source 20 to signal converting circuit 30, a signal having a waveform similar to graph (a) of FIG. 4 with only the maximum voltage being different is provided to an input-side terminal of photocoupler 328. Here, during a time period corresponding to the ON time of the dimming signal, photocoupler 328 is in a low-resistance state between output terminals, as a result of light being emitted from the input-side LED of photocoupler 328. Accordingly, node N1 is grounded, and voltage V1 of the signal at nods N1 is at a low level.

On the other hand, during a time period corresponding to the OFF time of the dimming signal, light is not emitted from, the input-side LED of photocoupler 328, and thus photocoupler 328 is in a high-resistance state between the output terminals. In this manner, voltage Vcc is applied from the DC power supply to node N1, and thus voltage V1 of the signal at node N1 is at a high level. Accordingly, voltage V1 of the signal at node N1 has a waveform resulting from inverting the dimming signal, as indicated in graph (b) of FIG. 4.

When voltage V1 of the signal at node N1 is at a high level, a bias voltage corresponding to voltage V1 is applied between the base and the emitter of transistor 340. Accordingly, transistor 340 is in a low-resistance state between the collector and the emitter. With this, since node N2 is practically grounded, voltage V3 of the signal at node N3 is at a low level.

On the other hand, when voltage V1 of the signal at node N1 is at a low level, a voltage between the base and the emitter of transistor 340 reaches substantially zero. Accordingly, transistor 340 is in a high-resistance state between the collector and the emitter. In this manner, voltage Vcc is applied from the DC power supply to node N3, and thus voltage V3 of the signal at node N3 is at a high level. Accordingly, voltage V3 of the signal at node N3 has a waveform resulting from inverting the waveform of voltage V1 of the signal at node N1, as illustrated in graph (c) of FIG. 4. In other words, voltage V3 of the signal at node N3 has a waveform similar to the waveform of the dimming signal. It should be noted that an amount of time corresponding to the time constant of an RC circuit in inverting circuit 34 is taken from when voltage V1 of the signal at node N1 has changed to when voltage V3 of the signal at node N3 changes. However, since the time constant is sufficiently small, it is possible to regard the waveform of voltage V3 of the signal at node N3 as a substantially rectangular wave.

When voltage V3 of the signal at node N3 is at a high level, a bias voltage corresponding to voltage V3 is applied between the base and the emitter of transistor 360. Accordingly, transistor 360 is in a low-resistance state between the collector and the emitter. With this, since node N4 is practically grounded, voltage V5 of the signal at node N5 is at a low level.

On the other hand, when voltage V3 of the signal at node N3 is at a low level, a voltage between the base and the emitter of transistor 360 reaches substantially zero. Accordingly, transistor 360 is in a high-resistance state between the collector and the emitter. In this manner, voltage Vcc is applied from the DC power supply to node N5, and thus voltage V5 of the signal at node N5 is at a high level.

Here, an amount of time corresponding to the time constant of RC circuit 36 is taken from when voltage V3 of the signal at node N3 has changed to when voltage V5 of the signal at node N5 changes. The time constant of RC circuit 36 during charging and discharging is relatively large, and thus the waveform of voltage V5 of the signal at node N5 becomes a serrated curved line as illustrated by a solid hue in graph (d) of FIG. 4. In addition, according to the embodiment, the time constant of RC circuit 36 during charging is greater than the time constant of RC circuit 36 during discharging. For that reason, the waveform of voltage V5 of the signal at node N5 is relatively less inclined during charging (when the voltage increases) and relatively more inclined during discharging (when the voltage decreases).

Next, for understanding characteristics of the operation of signal converting circuit 30, a signal converting circuit according to comparison example 1 will be described with reference to FIG. 5.

Figure 5:
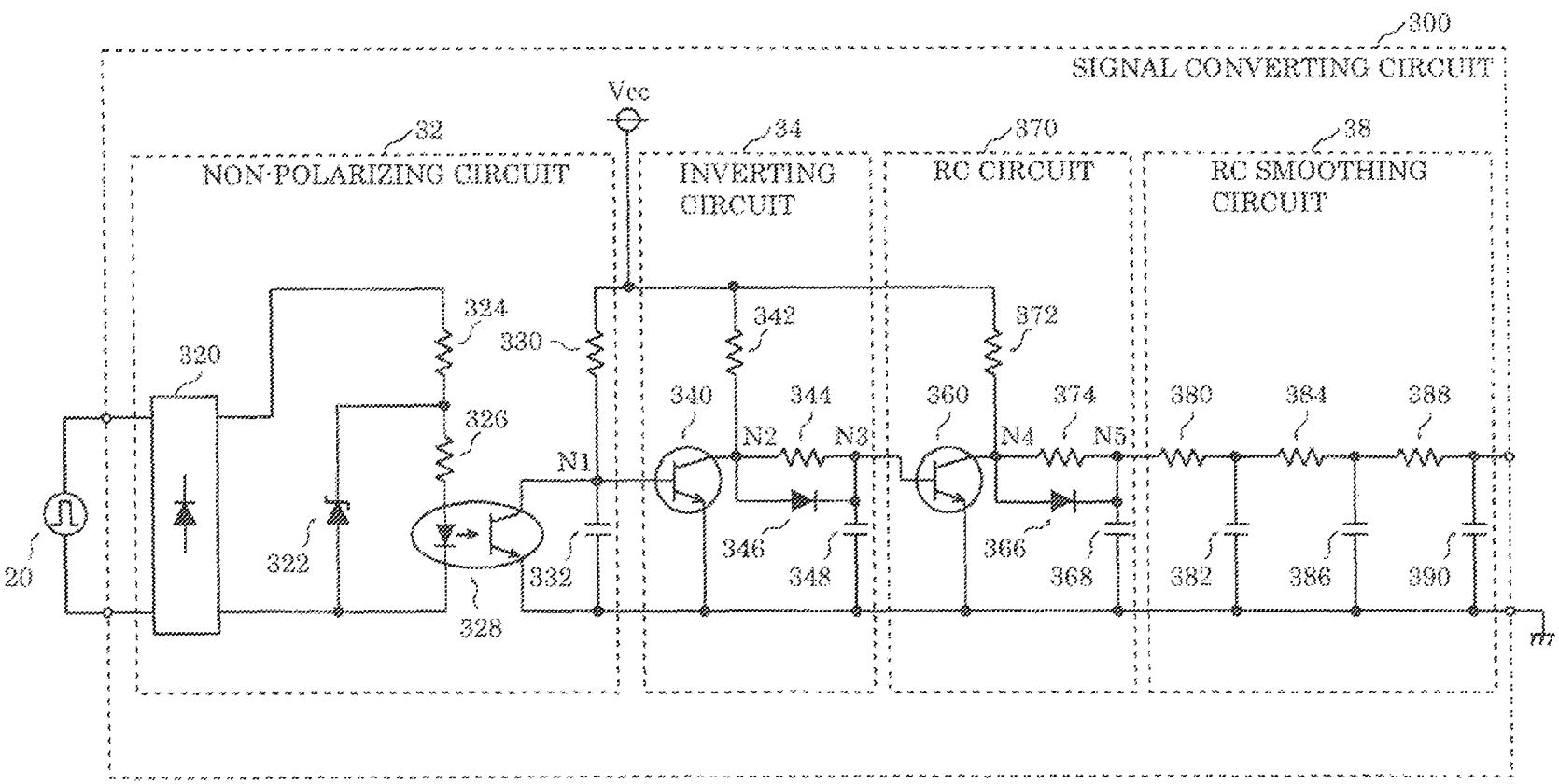
FIG. 5 is a circuit diagram illustrating a circuit configuration of a signal converting circuit according to comparison example 1.

FIG. 5 is a circuit diagram illustrating a circuit configuration of signal converting circuit 300 according to comparison example 1. It should be noted that dimming signal source 20 is illustrated together in this diagram.

As illustrated in FIG. 5, signal converting circuit 300 according to comparison example 1 is different from signal converting circuit 30 according to the embodiment, in the configuration of RC circuit 370. More specifically, resistance values of first resistor 372 and second resistor 374 of RC circuit 370 according to comparison example 1 differ from resistance values of first resistor 362 and second resistor 364 of RC circuit 36 according to the embodiment. According to comparison example 1, each of a resistance value of first resistor 372 and a resistance value of second resistor 374 is 200 kΩ. When the resistance value of first resistor 372 and the resistance value of second resistor 374 are the same as in comparison example 1, the time constant of RC circuit 370 during charging and the time constant of RC circuit 370 daring discharging are the same. In this case, the duty ratio of a dimming signal is proportional to voltage Vca of an output signal of signal converting circuit 300.

In addition, a resistance value of first resistor 372 according to comparison example 1 is smaller than a resistance value of first resistor 362 according to the embodiment, and a resistance value of second resistor 374 according to comparison example 1 is greater than a resistance value of second resistor 364 according to the embodiment. Accordingly, the time constant of RC circuit 370 according to comparison example 1 during charging is smaller than the time constant of RC circuit 36 according to the embodiment during charging. Furthermore, the time constant of RC circuit 370 according to comparison example 1 during discharging is greater than the time constant of RC circuit 36 according to the embodiment during discharging. Here, voltage V5*a* of the signal, at node N5 of RC circuit 370 according to comparison example 1 will be examined.

A waveform of voltage V5*a* of a signal at node N5 according to comparison example 1 is illustrated by a dashed line in graph (a) of FIG. 4. As illustrated in graph (d) of FIG. 4, the waveform indicated by the dashed line is more inclined during charging of RC circuit 36 and less inclined during discharging of RC circuit 36, than the waveform indicated by the solid line. Accordingly, voltage Vca of the output signal of signal converting circuit 300, which is an average value of voltage V5*a* of the signal at node N5 according to comparison example 1, is greater than voltage Vc of the output signal of signal converting circuit 30 according to the embodiment. However, voltage Vc according to the embodiment and voltage Vca according to the comparison example each approach zero as the duty ratio of the dimming signal approaches one, and the difference between voltage Vc and voltage Vca decreases. Furthermore, voltage Vc according to the embodiment and voltage Vca according to the comparison example each approach a certain value greater than zero as the duty ratio of the dimming signal approaches zero, and the difference between voltage Vc and voltage Vca decreases. Here, a relationship between the duty ratio of the dimming signal and voltage Vc according to the embodiment will be described with reference to FIG. 6.

Figure 6:
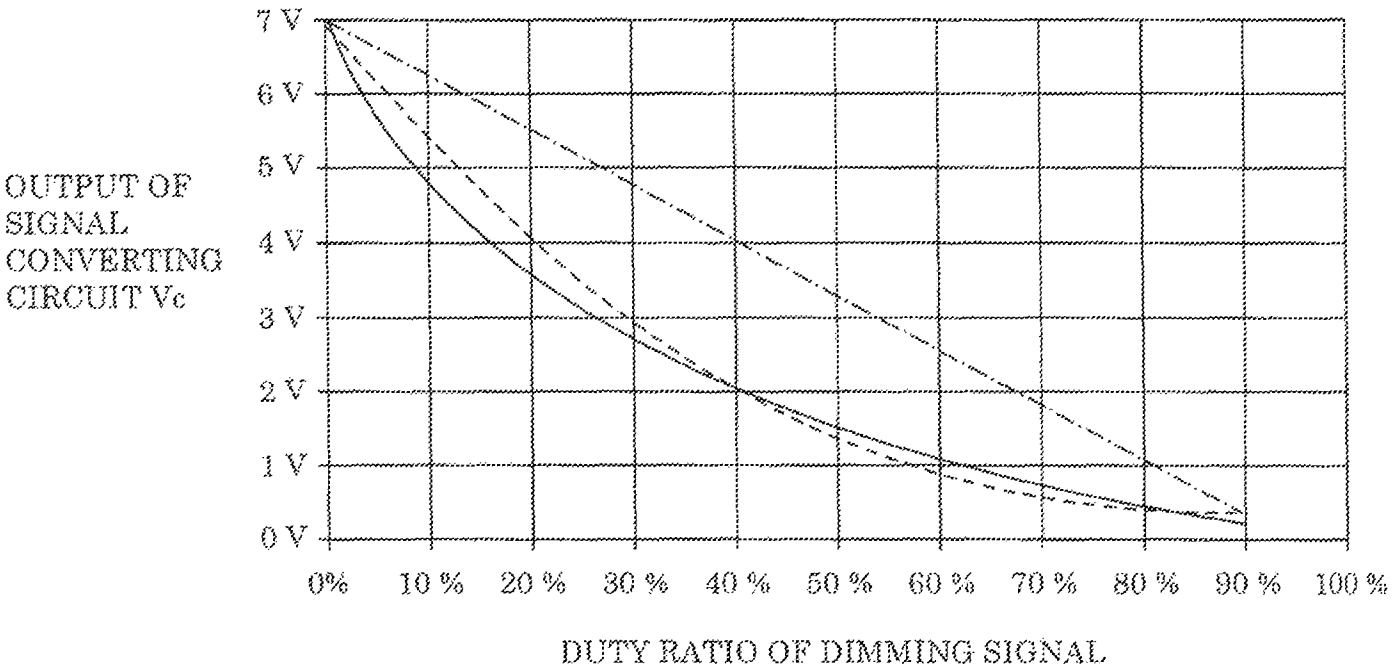
FIG. 6 is a diagram illustrating a graph indicating a relationship between a duty ratio of a dimming signal and a voltage of an output signal of the signal converting circuit according to the embodiment.

FIG. 6 is a diagram illustrating a graph indicating a relationship between the duty ratio of the dimming signal and voltage Vc of an output signal of signal converting circuit 30 according to the embodiment. In FIG. 6, the graph indicating a relationship between the duty ratio of the dimming signal and voltage Vc of an output signal of signal converting circuit 30 according to the embodiment is illustrated by a solid line. FIG. 6 also illustrates, by a dashed-dotted line, a graph indicating a relationship between the duty ratio of the dimming signal and voltage Vca according to comparison example 1. Furthermore, FIG. 6 illustrates, by a dashed line, a graph indicating the case where voltage Vc is proportional to the 2.3th power of the duty ratio of the dimming signal (the 2.3th power curve, as it is called).

As illustrated in FIG. 6, the relationship between the duty ratio of the dimming signal and voltage Vc of the output signal of signal converting circuit 30 according to the embodiment is non-linear. In addition, the graph of voltage Vc according to the embodiment has a shape close to the 2.3th power curve indicated by the dashed line. As stated above, the relationship between the duty ratio of the dimming signal and voltage Vc according to comparison example 1 is linear as illustrated in FIG. 6.

Here, a lighting device and a luminaire according to comparison example 2 for truly recreating the 2.3th power of curve as indicated by the dashed line in FIG. 6 will be described.

Figure 7:
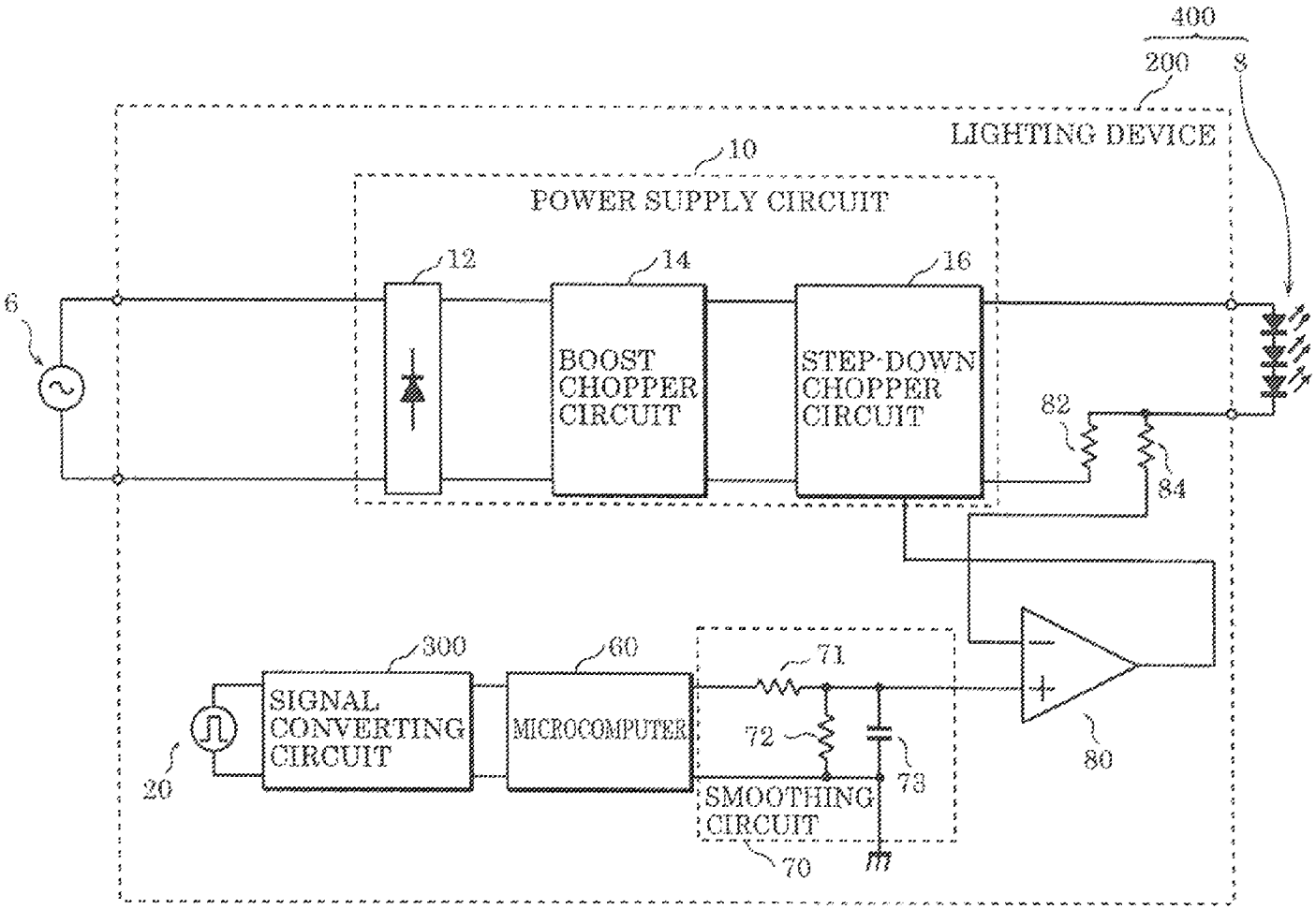
FIG. 7 is a circuit diagram illustrating a circuit configuration of a lighting device and a luminaire according to comparison example 2.

FIG. 7 is a circuit diagram illustrating a circuit configuration of lighting device 200 and luminaire 400 according to comparison example 2. It should be noted that AC power supply 6 which outputs an AC voltage is illustrated together in tins diagram.

As illustrated in FIG. 7, luminaire 400 includes lighting device 200 and solid-state light-emitting element 8.

Lighting device 200 includes power supply circuit 10, dimming signal source 20, signal converting circuit 300, operational amplifier 80, and resistors 82 and 84 as with lighting device 2 according to the embodiment. Lighting device 200 further includes microcomputer 60 and smoothing circuit 70. Here, signal converting circuit 800 has a configuration similar to the configuration of signal converting circuit 300 according to comparison example 1. Accordingly, output voltage Vca of signal converting circuit 300 is proportional to the duty ratio of the dimming signal provided from dimming signal source 20 (see the graph of the dashed-dotted line in FIG. 6).

Microcomputer 60 is a circuit to which an output voltage of signal converting circuit 300 is inputted and outputs a DC voltage signal to smoothing circuit 70. Microcomputer 60 converts a voltage of an inputted signal based on a conversion table or the like stored therein, and outputs a DC voltage signal having a voltage proportional to the 2.3th power of the voltage of the inputted signal.

Smoothing circuit 70 is a circuit which smoothes an output signal of microcomputer 60. Smoothing circuit 70 outputs the signal which has been smoothed to the non-inverting input terminal of operational amplifier 80. As illustrated in FIG. 7, smoothing circuit 70 includes resistors 71 and 72, and capacitor 73.

Resistors 71 and 72 are elements for dividing a voltage of a DC voltage signal inputted from microcomputer 60 as with voltage-dividing circuit 40 according to the present embodiment.

Capacitor 73 is an element which smoothes the DC voltage signal which has been inputted.

lighting device 200 according to comparison example 2 has such a configuration as described above, and thus is capable of supplying current having a current value proportional to the 2.3th power of the duty ratio of the dimming signal to solid-state light-emitting element 8. More specifically, with luminaire 400 according to comparison example 2, the dimming ratio is proportional to the 2.3th power of the duty ratio of the dimming signal. With this, it is possible to linearly vary the brightness perceived by a user with respect to an amount of dimming operation performed by the user. However, lighting device 200 according to comparison example 2 includes microcomputer 60 as illustrated in FIG. 7, and thus a region for mounting microcomputer 60 is required in a circuit board of lighting device 200. In other words, a larger mounting area on the circuit board is required compared to the case where a microcomputer is not included. Furthermore, by including the microcomputer, the costs of lighting device 200 and luminaire 400 increase compared to the case where the microcomputer is not included.

On the other hand, with lighting device 2 and luminaire 4 according to the embodiment, it is possible to make the relationship between a duty ratio of a dimming signal and a dimming ratio closer to the relationship represented by the 2.3th power curve, without using a microcomputer. More specifically, with lighting device 2 and luminaire 4 according to the embodiment, it is possible, with a simplified configuration, to make the relationship between a duty ratio of a dimming signal and brightness which a person perceives from light emitted from a solid-state light-emitting element more linear.

[4. Advantageous Effects, etc]

As described above, lighting device 2 according to the embodiment includes signal converting circuit 30 which receives a dimming signal that is a rectangular voltage signal and converts the dimming signal to a DC voltage signal corresponding to a duty ratio of the dimming signal. In addition, lighting device 2 further includes power supply circuit 10 which receives an AC voltage and outputs DC current having a current value corresponding to the DC voltage signal. Signal converting circuit 30 includes RC circuit 36 which integrates a signal corresponding to a dimming signal by way of charging and discharging to produce the DC voltage signal, and a time constant of RC circuit 36 during charging is greater than a time constant of the RC circuit during discharging.

With this, lighting device 2 according to the embodiment is capable of making the relationship between a duty ratio of a dimming signal and brightness which a person perceives from light emitted from a solid-state light-emitting element more linear. Moreover, lighting device 2 according to the embodiment does not include a microcomputer, and thus a configuration of lighting device 2 is simplified. This allows space saving of a circuit hoard of lighting device 2.

In addition, in lighting device 2 according to the embodiment, a time constant during discharging may be 10 times or greater of a period of a dimming signal.

This allows the dimming ratio to rapidly converge when the dimming signal is changed.

Furthermore, in lighting device 2 according to the embodiment, RC circuit 36 may include first resistor 362 second resistor 364 connected in series to first resistor 362; capacitor 368 connected in series to second resistor 364; and transistor 360 connected in parallel to a series circuit including second resistor 364 and capacitor 368. Here, the signal corresponding to the dimming signal may be coupled to a base of transistor 360, and the DC voltage signal may be derived from a voltage across the capacitor.

In addition, in lighting device 2 according to the embodiment, RC circuit 36 may include diode 368 connected in parallel to second resistor 364, and first resistor 362 may have a greater resistance value than a resistance value of second resistor 364.

In addition, in lighting device 2 according to the embodiment, a current value of DC current outputted by power supply circuit 10 may have a positive correlation with a voltage value of a DC voltage signal.

Furthermore, luminaire 4 according to the embodiment includes lighting device 2 and solid-state light-emitting element 8 which receives DC current outputted from lighting device 2.

This allows luminaire 4 to produce advantageous effects same as the advantageous effects produced by lighting device 2.

Modification example, etc.

Although lighting device 2 and luminaire 4 according to the present disclosure are described based on the embodiment, the present disclosure is not limited to the above-described embodiment.

For example, in the RC circuit of the lighting device according to the modification example, a rectifying element need not be disposed between transistor 360 and capacitor 368. This modification example will be described with reference to FIG. 8.

Figure 8:
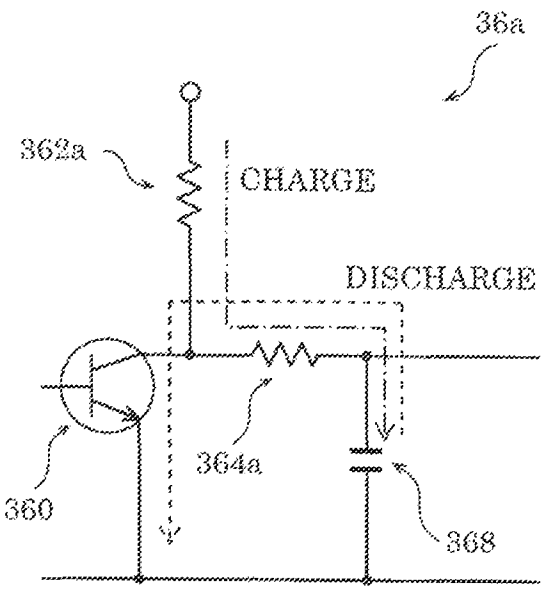
FIG. 8 is a circuit diagram illustrating a circuit configuration of an RC circuit according to a modification example.

FIG. 8 is a circuit diagram illustrating a circuit configuration of RC circuit **36*a* according to a modification example. It should be noted that FIG. 8 also illustrates current paths in RC circuit 36*a*** during charging and during discharging.

As illustrated, in FIG. 8, RC circuit **36*a* according to the present modification example includes transistor 360, first resistor 362*a*, second resistor 364*a*, and capacitor 368. In this manner, RC circuit 36*a* is different from RC circuit 36 in that RC circuit 36*a* does not include a rectifying element between transistor 360 and capacitor 368. In addition, a resistance value of first resistor 362*a* and a resistance value of second resistor 364*a* of RC circuit 36*a* are different from a resistance value of first resistor 362 and a resistance value of second resistor 364 of RC circuit 36**, respectively.

As illustrated by a dashed-dotted directional line in FIG. 8, an RC circuit serving as a current path during charging of capacitor 368 is formed of first resistor **362*a*, second resistor 364*a* and capacitor 368. Accordingly, a time constant of the RC circuit during charging is represented by a product of a sum of resistance values of first resistor 362*a* and second resistor 364*a* and capacitance of capacitor 368**.

In contrast, as illustrated by a dashed directional line in FIG. 8, the RC circuit which serves as a current path during discharging of capacitor 368 is formed of second resistor **364*a* and capacitor 368. Accordingly, a time constant during discharging is represented by a product of a resistance value of second resistor 364*a* and capacitance of capacitor 368**.

According to the present modification example, 230 kΩ and 100 kΩ are adopted as a resistance value of first resistor

362*a* and a resistance value of second resistor 364*a*, respectively, and 0.1 μF is adopted as capacitance of capacitor 368 as with the embodiment. In this manner, a time constant of RC circuit 36*a* during charging and a time constant of RC circuit 36*a* during discharging are same as a time constant of RC circuit 36 during charging and a time constant of RC circuit 36 during discharging according to the embodiment, respectively. In other words, RC circuit 36*a* is a circuit equivalent to RC circuit 36. Accordingly, in lighting device 2 according to the embodiment, RC circuit 36*a* according to the present modification example may be employed in place of RC circuit 36. RC circuit 36*a* according to the present modification example does not include a rectifying element such as a diode, and thus it is possible to further simplify the circuit configuration than RC circuit 36 according to the embodiment. It should be noted that, in the present modification example, first resistor 362*a* and second resistor 364*a* may have the same resistance value. Even when first resistor 362*a* and second resistor 364*a* have the same resistance value, a time constant of RC circuit 36*a* during charging is greater than a time constant of RC circuit 36*a* during discharging.

Although a dimming signal has a frequency of 1 kHz in dimming signal source 20 according to the embodiment, the frequency of the dimming signal is not limited to 1 kHz. For example, a dimming signal may have a frequency of 100 Hz. In this case, in order to obtain dimming characteristics same as dimming characteristics of the case where a dimming signal has a frequency of 1 kHz in lighting device 2, time constants of RC circuit 36 during charging and during discharging may each be set to 1 kHz/100 Hz times, i.e., multiplied by 10.

Although a boost chopper circuit and a step-down chopper circuit are employed in fighting device 2 according to the embodiment, the present disclosure is not limited to this configuration. For example, only one of a boost chopper circuit, a step-down chopper circuit, and a buck-boost converter may be employed.

Furthermore, although a dimming ratio has characteristics similar to the characteristics of being proportional to the 2.3th power of a duty ratio of a dimming signal in lighting device 2 according to the embodiment, the characteristics of the dimming ratio is not limited to such characteristics. For example, in lighting device 2, a dimming ratio may have characteristics similar to the characteristics of being proportional to the 2.7th power of a duty ratio of a dimming signal.

Moreover, embodiments obtained through various modifications to the embodiment and modification which may be conceived by a person skilled in the art as well as embodiments realized by arbitrarily combining the structural components and functions of the embodiment and modification without materially departing from the spirit of the present disclosure are included in the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall, within the true scope of the present teachings.

What is claimed is:

1. A lighting device, comprising:

a signal converting circuit which receives a dimming signal that is a rectangular voltage signal, and converts the dimming signal to a DC voltage signal corresponding to a duty ratio of the dimming signal; and a power supply circuit which receives an AC voltage and outputs DC current having a current value corresponding to the DC voltage signal, wherein the signal converting circuit includes a resistor-capacitor (RC) circuit which integrates a signal corresponding to the dimming signal by way of charging and discharging to produce the DC voltage signal, and a time constant of the RC circuit during charging is greater than a time constant of the RC circuit daring discharging.

2. The lighting device according to claim 1, wherein the time constant of the RC circuit during discharging is 10 times or greater than a period of the dimming signal.

3. The lighting device according to claim 1, wherein the RC circuit includes; a first resistor; a second resistor connected in series to the first resistor; a capacitor connected in series to the second resistor; and a transistor connected in parallel to a series circuit including the second resistor and the capacitor, wherein the signal corresponding to the dimming signal is coupled to a base of the transistor, and the DC voltage signal is derived from a voltage across the capacitor.

4. The lighting device according to claim 3, wherein the RC circuit includes a rectifying element connected in parallel to the second resistor, and the first resistor has a greater resistance value than a resistance value of the second resistor.

5. The lighting device according to claim 3, wherein a rectifying element is not disposed between the transistor and the capacitor.

6. The lighting device according to claim 1, wherein the current value of the DC current outputted by the power supply circuit has a positive correlation with a voltage value of the DC voltage signal.

7. A luminaire comprising:

the lighting device according to claim 1; and a solid-state light-emitting element which receives the DC current outputted from the lighting device.

* * * * *